US007774890B1

(12) United States Patent
Weiss, Jr.

(10) Patent No.: US 7,774,890 B1
(45) Date of Patent: Aug. 17, 2010

(54) DRAIN INSERT FOR SCRUBBING AND SCRAPING UTENSILS

(76) Inventor: Walter Weiss, Jr., 6736 Apollo Rd., West Linn, OR (US) 97068

( * ) Notice: Subject to any disclaimer, the term of this patent is extended or adjusted under 35 U.S.C. 154(b) by 547 days.

(21) Appl. No.: 11/743,933

(22) Filed: May 3, 2007

(51) Int. Cl.
*E03C 1/262* (2006.01)

(52) U.S. Cl. ..... 15/160; 15/104.92; 15/236.01; 15/236.03; 15/236.05

(58) Field of Classification Search ..... 15/105, 15/160, 104.92, 246, 236.01, 236.03, 236.05, 15/236.09; 4/292, 295, 286
See application file for complete search history.

(56) References Cited

U.S. PATENT DOCUMENTS 2,591,482 A * 4/1952 Weltlich ..... 220/700
3,395,828 A * 8/1968 Schnabel ..... 220/697
4,504,996 A 3/1985 Loos
5,265,281 A 11/1993 McAlpine
5,377,362 A * 1/1995 Jackson ..... 4/292
5,404,596 A * 4/1995 Coory ..... 4/287
5,473,782 A 12/1995 Coakley
D441,536 S * 5/2001 Jackson-MacDonald ..... D4/118
2006/0272080 A1 12/2006 Walsh

* cited by examiner

*Primary Examiner*—Monica S Carter
*Assistant Examiner*—Stephanie Newton

(57) ABSTRACT

A sink drain insert for use with a sink equipped with a powered garbage disposal unit. The insert comprises a cylindrical base having debris dislodging means which may be one of brushes, a scraper or some combination thereof, wherein food debris that are adhered to utensils may be scrubbed or scraped to dislodged the debris, allowing the debris to fall into the garbage disposal. The outer wall of the sink drain insert further comprises a circular sealing member for affixing and restraining the insert into the sink drain at the user's discretion.

17 Claims, 1 Drawing Sheet

DRAIN INSERT FOR SCRUBBING AND SCRAPING UTENSILS

CROSS-REFERENCE TO RELATED APPLICATIONS

Not applicable

STATEMENT REGARDING FEDERALLY SPONSORED RESEARCH

Not applicable

SEQUENCE LISTING

Not applicable

BACKGROUND OF THE INVENTION

1. Field of the Invention

This invention relates to a removable sink drain insert for scrubbing and scraping adhered debris, such as adhered food debris from utensils into a sink drain equipped with a garbage disposal.

2. Description of Prior Art

Kitchen sinks are often equipped with a powered garbage disposal. The garbage disposal is normally located directly underneath the sink drain providing for convenient disposal of food scraps and food debris. The prior art has several examples of inventions seeking to make the use of the garbage disposal more convenient. However, these examples fail to adequately address the need to remove adhered debris from common eating ware and kitchen utensils such as forks, knives, spoons, spatulas, mixing spoons and the like.

Examples found in the prior art requires the user to place one hand into the sink area to grasp a scraping or scrubbing implement while the other hand holds a the item to cleaned such as a plate. This situation is inefficient because of the number of steps required to clean off an item, e.g., grasping the implement from the prior art sink insert with one hand, holding the item to be cleaned with the other hand, setting down the item, and directing the loosened debris into the garbage disposal inlet with the current free hand. Consequently, the user cannot operate the water sprayer often found on today's sink faucets systems at the same time while holding the implement and the item.

For example in U.S. Pat. No. 4,504,996, to Loos, provides a garbage disposal stopper-strainer with a rigid scraper. In Loos, it is intended that when a user wishes to clean debris from a utensil, the user must with one hand take the cleaning implement out of the stopper-strainer, while the other hand holds the utensil. The user then must use both hands to remove the debris from the utensil. After the debris is removed, the debris is directed into the garbage disposal inlet. This strategy of removing debris is also found in U.S. Pat. No. 5,377,362 to Jackson. In Jackson, instead of a scraper, a removable brush is retained within a garbage disposal stopper-strainer. When the user wishes to scrub a utensil, the user must grasp the removable brush from the stopper-strainer with one hand while the other hand holds the item to be scrubbed. Both hands are utilized to remove debris from the utensil and additional effort is required to ensure that the debris is directed into the garbage disposal inlet.

U.S. Pat. No. 5,473,782 to Coakley shows another garbage disposal sink-strainer with a scraper. In Coakley, the device incorporates a plunger to push debris into the garbage disposal chamber. However, this device also suffers from the same shortcomings as the prior two patents mentioned above, in that the scraping device must be removed from its housing within the sink-strainer by one hand while the other hand is used to hold the item to be scraped. Consequently, in the three prior art references discussed above, the user does not have a free second hand in which to operate the sink faucet or sink faucet sprayer or the garbage disposal unit.

Accordingly, what is required is a device that allows a user to use a single hand to efficiently take off debris from eating utensils while at the same time, the debris is directed into the garbage disposal unit.

BRIEF SUMMARY OF THE INVENTION

A sink drain insert for fitting in the drain of a sink, equipped with a garbage disposal, having debris dislodging means, whereby a user need not remove the insert to scrap or scrub utensils and whereby the debris is directly conducted into the garbage disposal.

Other features and advantages of the present invention will become apparent from the following detailed description taken into conjunction with the accompanying drawings which illustrate by way of example the principles of the invention.

DETAILED DESCRIPTION OF THE PREFERRED EMBODIMENT

Figure 1:
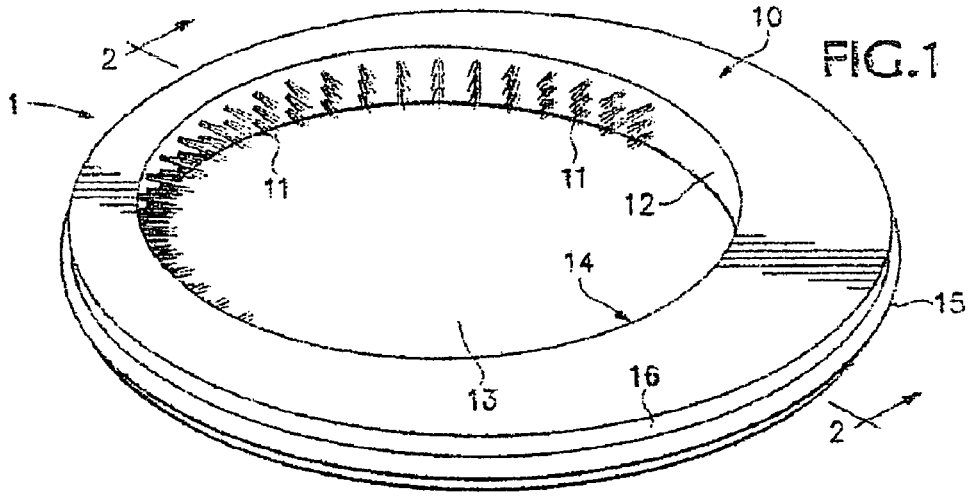
FIG. 1 is a perspective view of a first embodiment of the invention.

FIG. 1 shows a first embodiment of the sink-drain insert 1. Insert 1 comprises a rigid cylindrical base 10 having an annular cross-section. Base 10 is adapted to fit into a sink drain outlet 100. Base 10 has an outer wall 16 and an inner wall 12. Base 10 also has an edge 14.

Walls 12 and 16 form first aperture 13 and second aperture 21, by which solid debris and liquid may be conducted through. In the preferred embodiment shown in FIG. 1 and FIG. 2, the cross-sectional area of aperture 13 is smaller than that of aperture 21.

Figure 2:
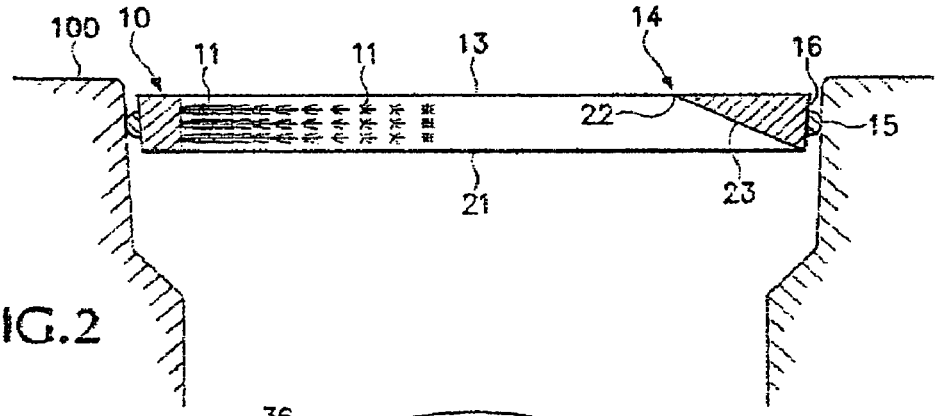
FIG. 2 is a cross-sectional view, shown in-situ, along line 2 of the embodiment of FIG. 1

Base 10 also includes food dislodging means which include brushes, a scraper or a combination thereof. In the embodiment of FIGS. 1 and 2, a plurality of resilient brush elements 11 are fixedly attached to a first portion of inner wall 12. Brush elements 11 extend perpendicularly away from wall 12. Brush elements 11 are sufficiently stiff so as to brush and scrub food debris from utensils. Brush elements 11 may comprise a series of brush tufts of one-piece construction having a first connecting end fixed to said inner circumferential surface and a distal end having a series of resilient fingers for scrubbing utensils. The art of attaching brush elements to a base is already known in the art and is discussed generally in Jackson, U.S. Pat. No. 5,377,362, col. 5, lines 26-43.

A scraper may also be incorporated into base 10 as follows. In a portion of edge 14, said portion having a sloping surface 23 extending therefrom, thereby forming a scraping edge 22, scraping edge 22 runs the circumferential length of said portion of the inner wall edge 14, wherein a utensil can be scraped along the portion to dislodge debris. Scraping edge 22 is adapted to be sufficiently rigid to dislodge debris adhered on utensils while being sufficiently resilient to resist breaking during the scraping action. In the preferred embodiment, scraping edge 22 may be half of the circumferential length of aperture 13.

Insert 1 is restrained within sink drain outlet 100 by an annular sealing member 15 that is affixed and restrained to wall 16. Sealing member 15 may be constructed from any durable elastomer or rubber. A common example would be O-rings or resilient washers. Sealing member 15 restrains insert 1 within the drain outlet, but is sufficiently resilient to allow the user to install and remove insert 1 at will.

Figure 3:
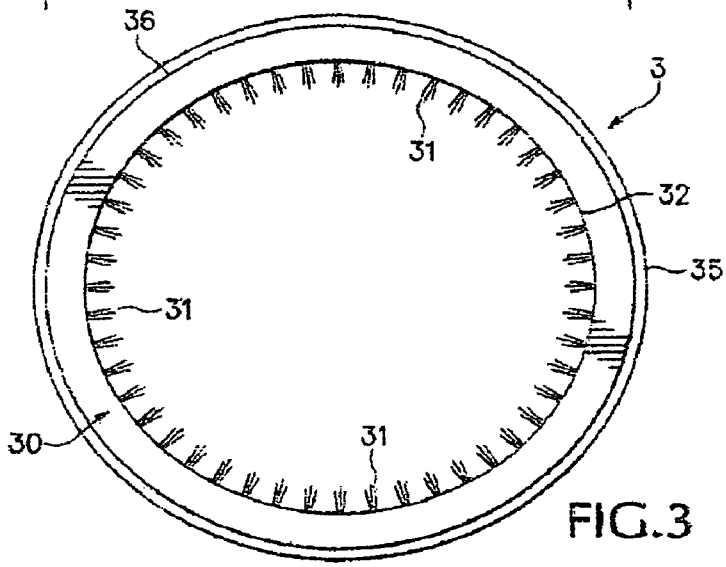
FIG. 3 is top view of a second embodiment of the invention.

An alternative embodiment is shown in FIG. 3. FIG. 3 shows Insert 3 comprising a single annular base 30. The embodiment in FIG. 3 is similar to the previous embodiment discussed with the exception that inner wall 32 does not have a scraper. Base 30 comprises an inner wall 32, to which is attached a plurality of brush elements 31. Brush elements 31 are attached in a predetermined pattern along the circumferential surface 32. Brush elements 31 are of similar construction and have similar properties as the brush elements of insert 1. Insert 3 further comprises an outer wall 36 to which is attached a resilient sealing member 35. Insert 3 is used in the same fashion as insert 1 except for scraping.

In a third embodiment, not shown, base 10 would have no brush elements but only a scraper formed by an edge 22 running the entire circumferential length of inner wall 12. In this third embodiment, utensils are to be scraped only and not brushed.

In use, the insert is firmly placed into drain outlet 100. The sealing member restrains the insert within the drain outlet. With a single hand, the user holds a utensil having adhered debris and scrubs the utensil against the brushes or scrapes the utensil against the scraper. The adhered food debris is loosened from the utensil and falls through the apertures directly into the garbage disposal inlet. Of course if the user desires, the user may use both hands to hold the utensil while scrubbing or scraping the utensil with the debris dislodging means.

To provide for economy of manufacturing cost, the base may be manufactured as a one-piece construction. The material of the base may be one of plastic, elastomer, metal and various combinations thereof.

A preferred embodiment of the invention has been described and illustrated for purposes of clarity and example, it must be understood that many changes, substitutions and modifications will become apparent to those possessed of ordinary skill in the art without thereby departing from the scope and spirit of the present invention which is defined by the following claims.

What is claimed is:

1. A sink drain insert for a sink drain equipped with a powered garbage disposal unit comprising:

a rigid cylindrical base adapted to fit into a sink drain outlet, said base having an outer wall and an inner wall, a first open end, and a second open end, wherein the passage of solid debris and liquid may pass through said open ends, said inner wall having an edge;

debris dislodging means, said dislodging means is "one of a brush element, a scraper and a combination of a brush element and a scraper"—a combination of a brush element and a scraper—, wherein said scraper comprises a portion of said edge of said inner wall, said portion of said edge having a sloping surface extending therefrom, thereby forming a scraping edge, said scraping edge running the circumferential length of said portion of said inner wall edge, wherein a utensil can be scraped along said portion to dislodge debris, wherein said dislodging means comprise a plurality of brush elements, said plurality of brush elements, each having a first distal end and a second distal end, said first distal ends being fixedly attached to said inner wall, said second distal ends extending perpendicularly away from said inner wall, said brush elements being adapted for brushings and scrubbing debris from utensils; and an annular resilient sealing member fixedly attached to said outer wall.

2. The drain insert of claim 1, wherein said base is of single piece construction.

3. The drain insert of claim 1, wherein said drain insert base is one of plastic, elastomer, metal, and various combinations thereof.

4. A sink drain insert for a sink drain equipped with a powered garbage disposal unit comprising:

a rigid cylindrical base adapted to fit into a sink drain outlet, said base having an outer wall and an inner wall, a first open end, and a second open end, wherein the passage of solid debris and liquid may pass through said open ends, said inner wall having an edge;

a plurality of brush elements, said plurality of brush elements, each having a first distal end and a second distal end, said first distal ends being fixedly attached to a first portion of said inner wall, said second distal ends extending perpendicularly away from said inner wall, said brush elements being adapted for brushing and scrubbing debris from utensils;

a scraper comprising a portion of said edge of said inner wall, said portion of said edge having a sloping surface extending away from said edge, thereby forming a scraping edge, said scraping edge running the circumferential length of said portion of said inner wall edge, wherein a utensil can be scraped along said portion to dislodge debris; and an annular resilient sealing member fixedly attached to said outer wall, wherein, said insert may be retained and removed from said sink drain at a user's discretion.

5. The drain insert of claim 4, wherein said base is of single piece construction.

6. The drain insert of claim 4, wherein said drain insert base is one of plastic, elastomer, metal, and various combinations thereof.

7. A device comprising:

a base configured to fit at least partially in a sink drain outlet, wherein the base includes an inner wall that forms an opening capable of allowing debris or liquid to pass through the sink drain outlet;

a scraper comprising at least a portion of the base, wherein a portion of the inner wall extends towards the opening to form a scraping edge of the scraper; and a brush element coupled to the inner wall of the base, wherein the brush element includes one or more distal ends extending away from the inner wall into the opening formed by the inner wall of the base.

8. The device of claim 7, wherein the scraping edge is configured to run a circumferential length of the portion of the inner wall.

9. The device of claim 7, wherein the scraper includes a sloping surface extending away from the scraping edge.

10. The device of claim 7, wherein the scraping edge is an upper edge of the inner wall.

11. The device of claim 7, wherein the scraping edge is configured to dislodge debris from a utensil.

12. The device of claim 7, further comprising an annular resilient sealing member coupled to at least a portion of an outer wall of the base.

13. The device of claim 12, wherein the annular resilient sealing member is configured to restrain the base to the sink drain outlet.

14. The device of claim 7, wherein the one or more distal ends extend perpendicularly away from the inner wall.

15. The device of claim 7, wherein the brush element is configured to brush or scrub debris from a utensil.

16. The device of claim 7, wherein the base is a single piece construction.

17. The device of claim 7, wherein the base is made of at least one of plastic, elastomer, or metal.

* * * * *